US010759637B2

(12) United States Patent
Richter et al.

(10) Patent No.: US 10,759,637 B2
(45) Date of Patent: Sep. 1, 2020

(54) SEGMENTED SHAPE-COMPLIANT WEAR PAD FOR TELESCOPING BOOM ASSEMBLY

(71) Applicant: Manitowoc Crane Companies, LLC, Manitowoc, WI (US)

(72) Inventors: Kurt W. Richter, Shippensburg, PA (US); John F. Benton, Smithburg, MD (US); Jonathan M. Burkett, Pittsburg, PA (US); Donald C. Hade, Jr., Greencastle, PA (US)

(73) Assignee: Manitowoc Crane Companies, LLC, Milwaukee, WI (US)

( * ) Notice: Subject to any disclaimer, the term of this patent is extended or adjusted under 35 U.S.C. 154(b) by 591 days.

(21) Appl. No.: 15/220,140

(22) Filed: Jul. 26, 2016

(65) Prior Publication Data

US 2017/0029253 A1 Feb. 2, 2017

Related U.S. Application Data

(60) Provisional application No. 62/199,167, filed on Jul. 30, 2015.

(51) Int. Cl.
*B66C 23/70* (2006.01)
*B66C 23/42* (2006.01)

(52) U.S. Cl.
CPC ..... *B66C 23/707* (2013.01); *B66C 23/701* (2013.01); *B66C 23/42* (2013.01)

(58) Field of Classification Search
CPC ..... B66C 23/701; B66C 23/707; B66C 23/42
See application file for complete search history.

(56) References Cited

U.S. PATENT DOCUMENTS 3,719,403 A 3/1973 Sung
4,004,695 A * 1/1977 Hockensmith ..... B66C 23/701 212/350

(Continued)

FOREIGN PATENT DOCUMENTS

DE 29613042 U1 9/1996
DE 202011100957 U1 8/2011

(Continued)

OTHER PUBLICATIONS

European Search Report issued by ISA/EPO in connection with EP16181455 dated Dec. 21, 2016.

*Primary Examiner* — Emmanuel M Marcelo
(74) *Attorney, Agent, or Firm* — Levenfeld Pearlstein, LLC

(57) ABSTRACT

A construction vehicle includes a telescoping boom assembly that includes a first section and at least a second section configured to nest within and to extend from the first section. At least one wear pad is positioned between the first section and the second section. The wear pad includes a length, a first surface, and a second surface spaced apart a height from the first surface. A first portion of the wear pad includes a first bending stiffness. The wear pad also includes a second portion having a second bending stiffness, wherein the second bending stiffness is different than the first bending stiffness. Optionally, the height of the wear pad between the first surface and the second surface is substantially the same in the first portion and the second portion. Optionally, the construction vehicle is a crane.

17 Claims, 11 Drawing Sheets

(56) References Cited

U.S. PATENT DOCUMENTS 4,045,936 A * 9/1977 Sterner ..... B66C 23/705 384/35
5,181,588 A * 1/1993 Emmons ..... F16D 55/226 188/71.1
5,678,662 A * 10/1997 Giorgetti ..... F16D 66/02 188/1.11 W
6,108,985 A 8/2000 Paschke et al.
6,145,843 A * 11/2000 Hwang ..... F16J 15/442 277/400
6,499,612 B1 * 12/2002 Harrgington ..... B66C 23/701 212/270
2005/0287927 A1 * 12/2005 Berman ..... B24B 37/04 451/5
2006/0016100 A1 * 1/2006 Riha ..... A43B 13/141 36/59 R
2008/0061626 A1 * 3/2008 Busley ..... B62D 55/275 305/46
2009/0057104 A1 * 3/2009 Boudreau ..... B65G 15/62 198/841
2010/0212185 A1 * 8/2010 Cooper ..... A43B 1/0072 36/12
2011/0214313 A1 * 9/2011 James ..... A43B 13/141 36/103
2012/0017470 A1 * 1/2012 Pan ..... A43B 3/108 36/103
2012/0055041 A1 * 3/2012 Mackey ..... A43B 7/141 36/28
2012/0251284 A1 * 10/2012 Lettau ..... E02F 3/286 414/722
2013/0020274 A1 * 1/2013 Munuswamy ..... B66C 23/701 212/347
2013/0247425 A1 * 9/2013 Davis ..... A43B 13/02 36/30 R
2014/0047690 A1 * 2/2014 Plantan ..... F16D 65/092 29/407.09
2014/0048362 A1 * 2/2014 Plantan ..... F16D 65/092 188/251 R
2015/0181976 A1 * 7/2015 Cooper ..... A43B 13/187 36/28
2018/0251348 A1 * 9/2018 Calaman ..... B66C 23/707

FOREIGN PATENT DOCUMENTS

EP 1314682 A2 5/2003
EP 2189413 A1 5/2010
EP 2202193 A2 6/2010
JP 2008265980 A 11/2008
JP 2011042496 A 3/2011
WO WO-9858711 A1 * 12/1998 ..... A63C 17/06
WO 2013007050 A1 1/2013

* cited by examiner

SEGMENTED SHAPE-COMPLIANT WEAR PAD FOR TELESCOPING BOOM ASSEMBLY

RELATED APPLICATION

The present patent document claims the benefit of priority to U.S. Provisional Patent Application No. 62/199,167, filed Jul. 30, 2015, and entitled "SEGMENTED SHAPE-COMPLIANT WEAR PAD FOR TELESCOPING BOOM ASSEMBLY," the entire contents of which are incorporated herein by reference.

BACKGROUND

The present application relates to construction equipment and machines equipped with telescoping boom assemblies, such as cranes, teleloaders, and the like. In particular, the present application relates to the wear pads—typically replaceable—that are positioned between the nested sections of the telescoping boom assemblies.

Wear pads typically support, in part, the weight of a section of a telescoping boom assembly relative to another section of the telescoping boom assembly. Wear pads also typically reduce the sliding friction between the various sections of the telescoping boom assembly. Further, the wear pads typically are designed to be replaceable. In other words, the wear pads are typically a relatively lower cost and more easily replaced feature of the telescoping boom assembly that reduces the wear and consequent replacement of the various sections of the telescoping boom assembly.

Presently known wear pads, however, may suffer from several deficiencies. First, telescoping boom assemblies have increased in structural sophistication from simple box/beam construction that require only flat wear pads to boom assemblies in which one or more section may have multiple segments of varying angles and/or radii of curvature. These latter boom designs typically require wear pads that are machined for a specific design of the section and, in some instances, for a specific, in-use section of a telescoping boom assembly. In other words, the proliferation of boom designs requires an equal proliferation of designs for wear pads. Therefore, the wear pads often require specific machining and adjustment of the wear pad at both the manufacturing level and at the field level when installing the wear pads.

Consequent to the proliferation of the number of designs of wear pads is the requirement to keep multiple and often uniquely sized and shaped blanks from which the wear pads are manufactured. The use of uniquely sized and shaped blanks typically costs significantly more than using off-the-shelf flats or standard shapes of blanks to manufacture a wear pad.

Thus, there is a need for a wear pad that is formed from a common blank or easily obtainable shape of material. There is also a need for a wear pad that reduces the amount of wasted raw material during the manufacturing of the wear pad. Further, there is a need for a wear pad that is easily machined for a variety of unique shapes of the various sections of a telescoping boom assembly, particularly one that is capable of conforming more easily to inconsistent or irregular contours. Finally, there is a need for a construction vehicle, particularly a crane, with a telescoping boom assembly equipped with such wear pads.

BRIEF SUMMARY

A wear pad for positioning between a first section and a second section of a telescoping boom assembly comprises a material that includes a first surface and a second surface spaced apart a height from the first surface, a length, and at least one groove that extends a depth into at least one of the first surface and the second surface. The depth of the groove is less than the height between the first surface and the second surface.

In another embodiment, a wear pad for positioning between a first section and a second section of a telescoping boom assembly comprises a material that includes a first surface and a second surface spaced apart a height from the first surface, a length, and at least one groove that extends a depth into at least one of the first surface and the second surface. The depth of the groove is less than the height between the first surface and the second surface. The wear pad further comprises a first portion that includes the at least one groove and a first bending plane positioned at a first distance between the first surface and the second surface. The wear pad also includes a second portion that includes a second bending plane positioned at a second distance between the first surface and the second surface, wherein the second distance is different than the first distance.

In yet another embodiment, a wear pad for positioning between a first section and a second section of a telescoping boom assembly comprises a material that includes a first surface and a second surface spaced apart a height from the first surface, a length, and at least one groove that extends a depth into at least one of the first surface and the second surface. The depth of the groove is less than the height between the first surface and the second surface. The wear pad further comprises a first portion that includes the at least one groove, the first portion having a first bending stiffness. The wear pad also includes a second portion having a second bending stiffness, wherein the second bending stiffness is different than the first bending stiffness.

In yet another embodiment, a wear pad for positioning between a first section and a second section of a telescoping boom assembly comprises a material that includes a first surface and a second surface spaced apart a height from the first surface, a length, and at least one groove that extends a depth into at least one of the first surface and the second surface. The depth of the groove is less than the height between the first surface and the second surface. The wear pad further comprises a first portion in which there exists a plurality of grooves. The plurality of grooves includes a pitch that defines the distance between the same structure or feature on adjacent grooves. Thus, in some embodiments, the wear pad includes a first portion with a given pitch between adjacent grooves and a second portion with a different pitch between the grooves in the second portion.

Also disclosed are embodiments of a construction vehicle. The construction vehicle includes a telescoping boom assembly that includes a first section and at least a second section configured to nest within and to extend from the first section. At least one wear pad is positioned between the first section and the second section. The wear pad includes a length, a first surface, and a second surface spaced apart a height from the first surface. A first portion of the wear pad includes a first bending plane positioned at a first distance between the first surface and the second surface. The wear pad also includes a second portion that includes a second bending plane positioned at a second distance between the first surface and the second surface, wherein the second distance is different than the first distance. Optionally, the height of the wear pad between the first surface and the second surface is substantially the same in the first portion and the second portion. Optionally, the construction vehicle is a crane.

Another embodiment of a construction vehicle includes a telescoping boom assembly that includes a first section and at least a second section configured to nest within and to extend from the first section. At least one wear pad is positioned between the first section and the second section. The wear pad includes a length, a first surface, and a second surface spaced apart a height from the first surface. A first portion of the wear pad includes a first bending stiffness. The wear pad also includes a second portion having a second bending stiffness, wherein the second bending stiffness is different than the first bending stiffness. Optionally, the height of the wear pad between the first surface and the second surface is substantially the same in the first portion and the second portion. Optionally, the construction vehicle is a crane.

In yet another embodiment, a construction vehicle includes a telescoping boom assembly that includes a first section and at least a second section configured to nest within and to extend from the first section. At least one wear pad is positioned between the first section and the second section. The wear pad includes a length, a first surface, and a second surface spaced apart a height from the first surface. The wear pad includes at least one groove that extends a depth into at least one of the first surface and the second surface. The wear pad optionally further comprises a first portion in which there exists a plurality of grooves. In some embodiments, the wear pad includes a first portion with a given pitch between adjacent grooves and a second portion with a different pitch between the grooves in the second portion. Optionally, the construction vehicle is a crane.

Also disclosed are methods of manufacturing a wear pad for positioning between a first section and a second section of a telescoping boom assembly. The method comprises obtaining a material having a length, a first surface, and a second surface spaced apart a height from the first surface. The method further comprises forming at least one groove that extends a depth into at least one of the first surface and the second surface, wherein the depth is less than the height between the first surface and the second surface.

Also disclosed are methods of installing a wear pad in position between a first section and a second section of a telescoping boom assembly of a crane. The method comprises providing a wear pad that includes a length, a first surface and a second surface spaced apart a height from the first surface, and at least one groove that extends a depth into at least one of the first surface and the second surface. The depth of the groove is less than the height between the first surface and the second surface. The method further comprises positioning the wear pad between the first section and the second section of a telescoping boom assembly.

Another embodiment of installing a wear pad in position between a first section and a second section of a telescoping boom assembly of a crane comprises providing a wear pad that includes a length, a first surface, and a second surface spaced apart a height from the first surface, and a first portion having a first bending stiffness. The wear pad includes a second portion having a second bending stiffness, wherein the second bending stiffness is different than the first bending stiffness. Optionally, the height of the wear pad between the first surface and the second surface is substantially the same in the first portion and the second portion. The method includes positioning the wear pad between the first section and the second section of a telescoping boom assembly.

Yet another method of installing a wear pad in position between a first section and a second section of a telescoping boom assembly of a crane includes providing a wear pad that includes a length, a first surface, and a second surface spaced apart a height from the first surface, and a first portion having a first bending plane. The wear pad includes a second portion having a second bending plane, wherein the position (i.e., the distance between the first surface and the second surface) of the second bending plane is different than the first bending plane. Optionally, the height between the first surface and the second surface is substantially the same in the first portion and the second portion. The method further includes positioning the wear pad between the first section and the second section of a telescoping boom assembly.

Yet another method of installing a wear pad in position between a first section and a second section of a telescoping boom assembly of a crane includes providing a wear pad that includes a length, a first surface, and a second surface spaced apart a height from the first surface. The wear pad includes at least a plurality of grooves that extends a depth into at least one of the first surface and the second surface, wherein the depth is less than the height between the first surface and the second surface. The plurality of grooves in a first portion has a first pitch and the plurality of grooves in a second portion has a second pitch. The method further includes positioning the wear pad between the first section and the second section of a telescoping boom assembly.

These and other advantages, as well as the invention itself, will become more easily understood in view of the attached drawings and apparent in the details of construction and operation as more fully described and claimed below. Moreover, it should be appreciated that several aspects of the invention can be used with other types of cranes, machines or equipment.

DETAILED DESCRIPTION

The present invention will now be further described. In the following passages, different aspects of the embodiments of the invention are defined in more detail. Each aspect so defined may be combined with any other aspect or aspects unless clearly indicated to the contrary. In particular, any feature indicated as being preferred or advantageous may be combined with any other feature or features indicated as being preferred or advantageous.

Figure 1:
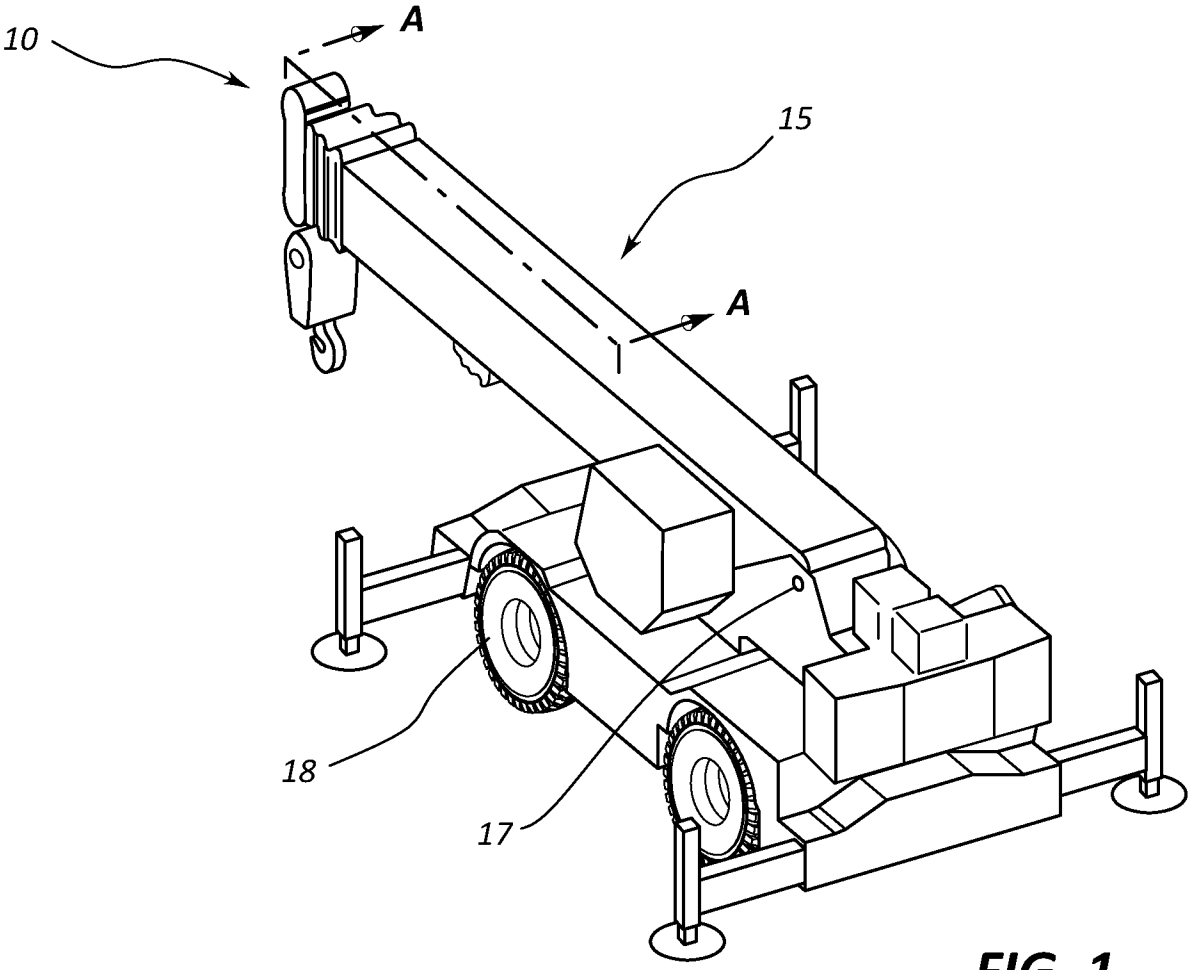
FIG. 1 is a perspective view of a construction vehicle with a telescoping boom assembly.

FIG. 1 illustrates a construction vehicle 10 that includes a telescoping boom assembly 15. The construction vehicle 10 may be configured with ground engaging members 18, such as wheels, tracks, rails, and the like to make the construction vehicle 10 mobile, or alternately the construction vehicle 10 may be a fixed, such as on a platform.

In some embodiments, the construction vehicle 10 is a mobile crane, as illustrated in FIG. 1. Of course, the construction vehicle 10 may be a teleloader or any other type of construction vehicle that includes a telescoping boom assembly 15.

Figure 2:
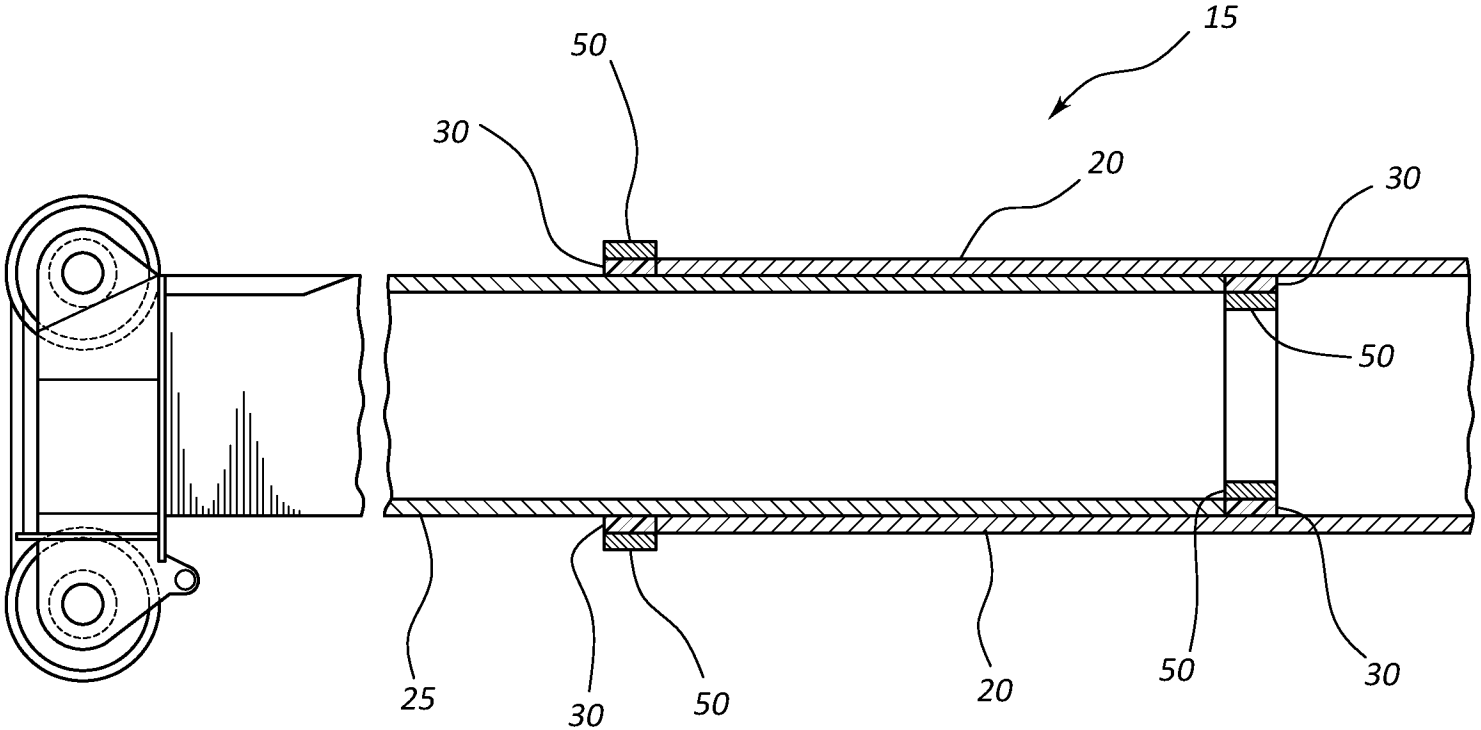
FIG. 2 is a cross-section A-A of the telescoping boom assembly in FIG. 1.

Illustrated in FIG. 2 is a cross-section A-A of the telescoping boom assembly 15 in FIG. 1. The telescoping boom assembly 15 is rectangular in cross-section, but as will be appreciated embodiments of the invention may be employed with telescoping boom assemblies that are square, rectangular, oval, segmented, or include one or more portions with a radius of curvature that is the same or different from the radius of curvature of another portion of the telescoping boom assembly.

The telescoping boom assembly 15 includes a first section 20 and at least a second section 25 configured to nest within, most typically, or nest around the first section 20. The second section 25 is capable of extending away from the first section 20. Thus, in FIG. 2, the second section 25 would extend leftward and away from the first section 20 and the boom pivot 17 (FIG. 1). Of course, the telescoping boom assembly 15 may include a plurality of nested sections.

At least one wear pad 30 is positioned between the first section 20 and the second section 25 of the telescoping boom assembly 15. Optionally, brackets 50 coupled to one of the first section 20 and the second section 25, are configured to at least one of receive and retain the wear pad 30 in position relative to the first section 20 or the second section 25 to which it is adjacent.

Figure 3:
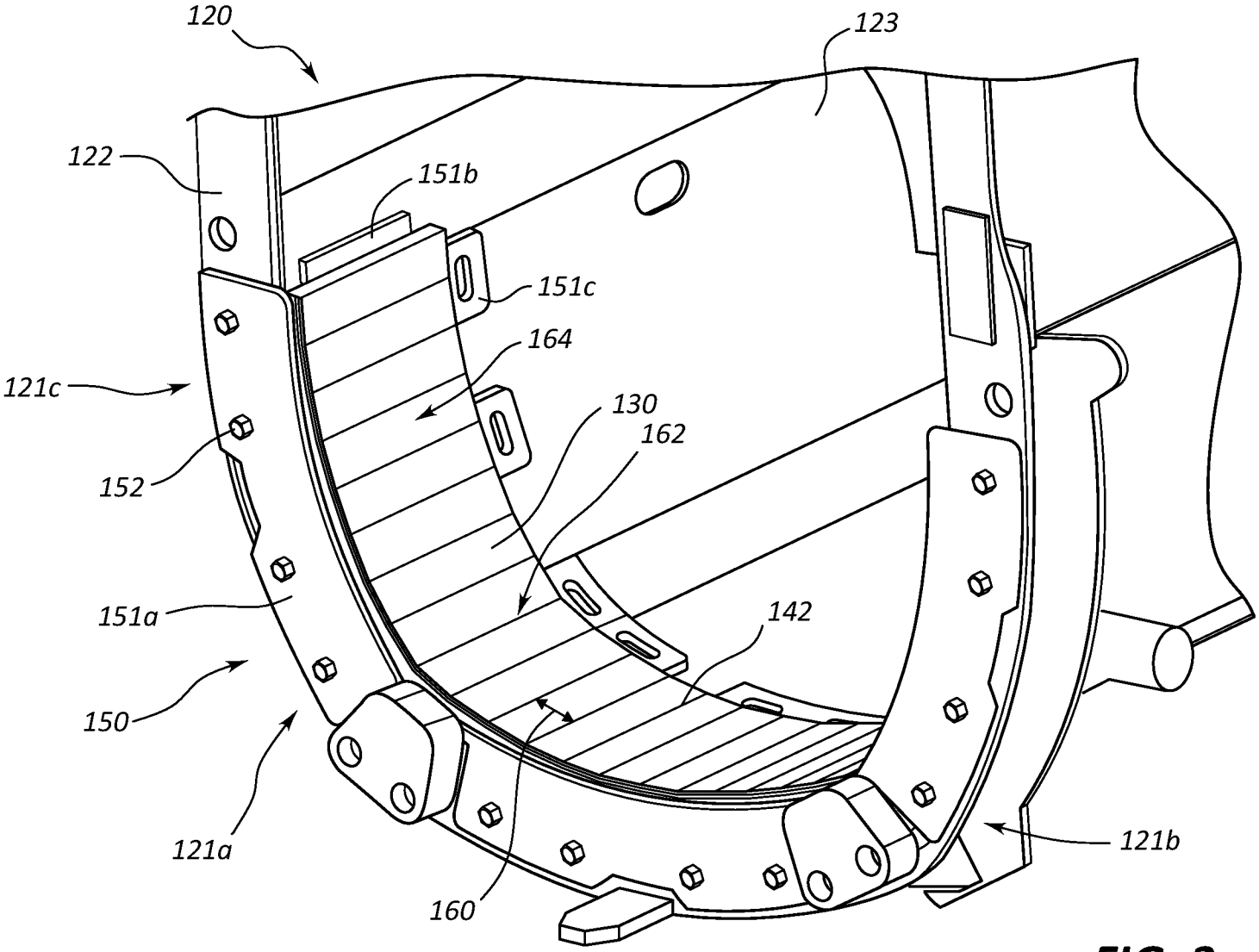
FIG. 3 is a perspective view of a first section of a telescoping boom assembly and associated wear pad.

Another embodiment of a first section 120 of a telescoping boom assembly is illustrated in perspective view in FIG. 3. (Note, a second section is not illustrated, but typically would be similar in appearance to the first section 120 as one of skill in the art would understand.) In this instance, the first section includes a plurality of portions 121*a*, 121*b*, 121*c*. Each portion 121*a*, 121*b*, 121*c* include a radius of curvature that varies from the radius of curvature of at least one of the other portions 121*a*, 121*b*, 121*c*.

A wear pad 130 optionally is at least one of received within and retained in position by the bracket 150. The bracket 150 optionally includes at least one or more positioning members 151*a*, 151*b*, 151*c*. The positioning members 151*a*, 151*b*, 151*c* may be a tab, flange, recess, groove, ridge, or any other similar structure configured to receive and/or retain the wear pad 130. The positioning members 151*a*, 151*b*, 151*c* may be integrally formed with each other and/or with the first section 120. As illustrated in FIG. 3, the positioning members 151*a*, 151*b*, 151*c* include a variety of flanges, such as plate steel and/or plastic, such as positioning member 151*a* that extend inward and away from a first end 122, and raised positioning members 151*b* and 151*c* that extend away from an inner surface 123 of the first section 120. The positioning members 151*a*, 151*b*, 151*c* may be adjustably fixed to the first section 120 with an attachment device 152, such as nuts, screws, bolts, slots and grooves, adhesives, and the like, that allow the positioning members 151*a*, 151*b*, 151*c* to be moved to accommodate manufacturing tolerances in the first section 120 and the wear pad 130.

Figure 4:
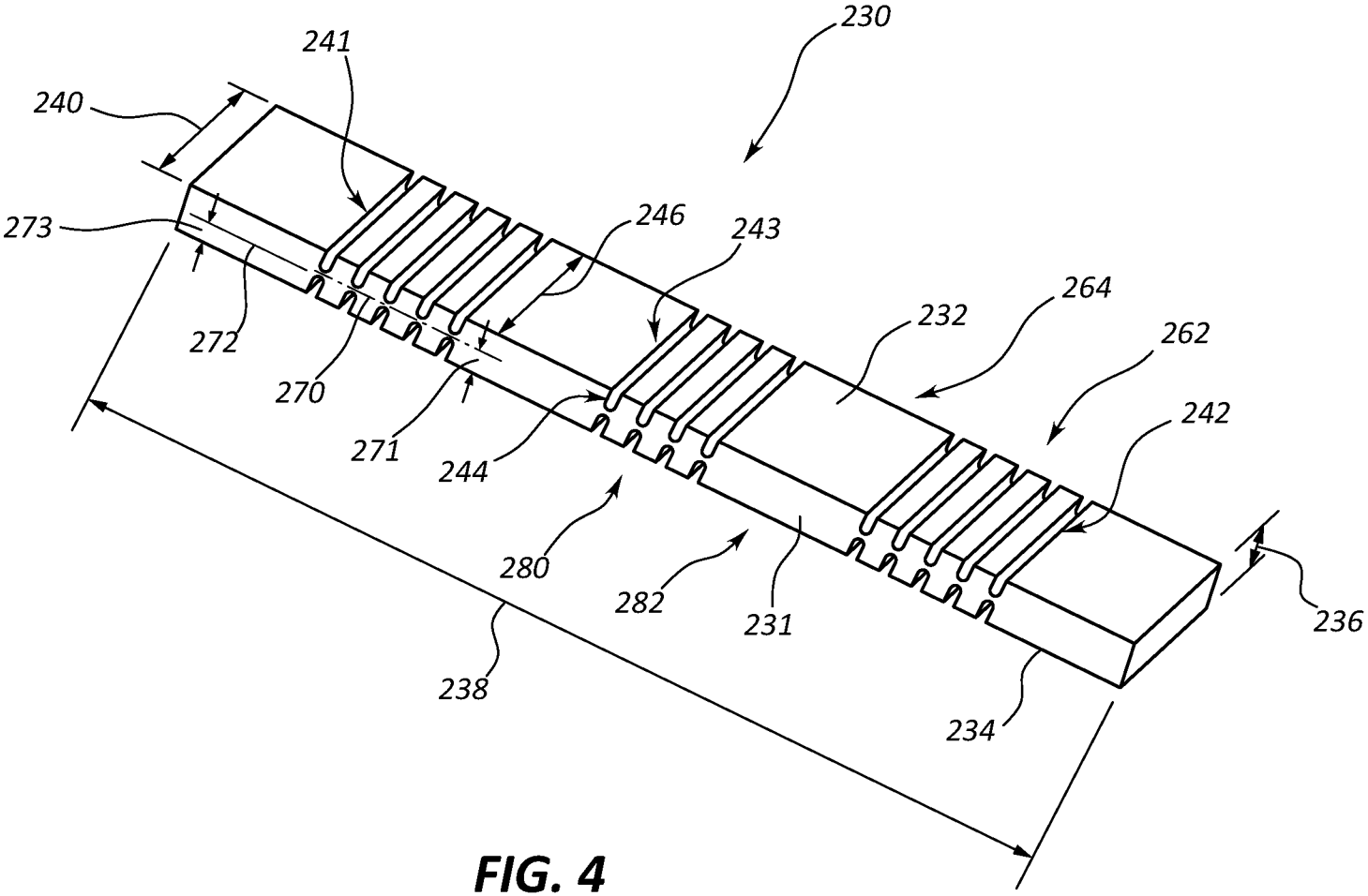
FIG. 4 is a perspective view of an embodiment of a wear pad in its uninstalled position.
Figure 5:
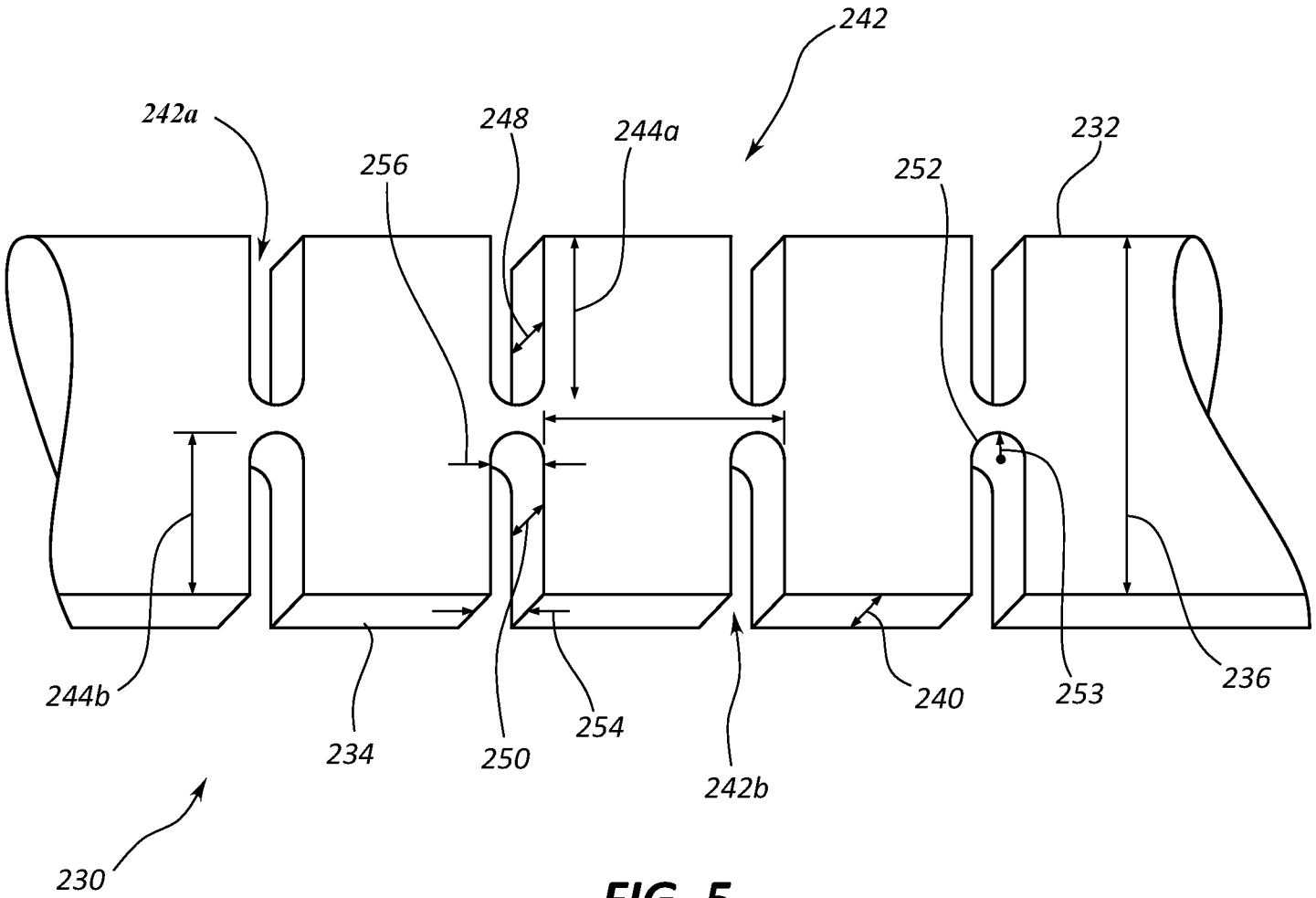
FIG. 5 is a close-up perspective view of the wear pad in FIG. 4.
Figure 6:
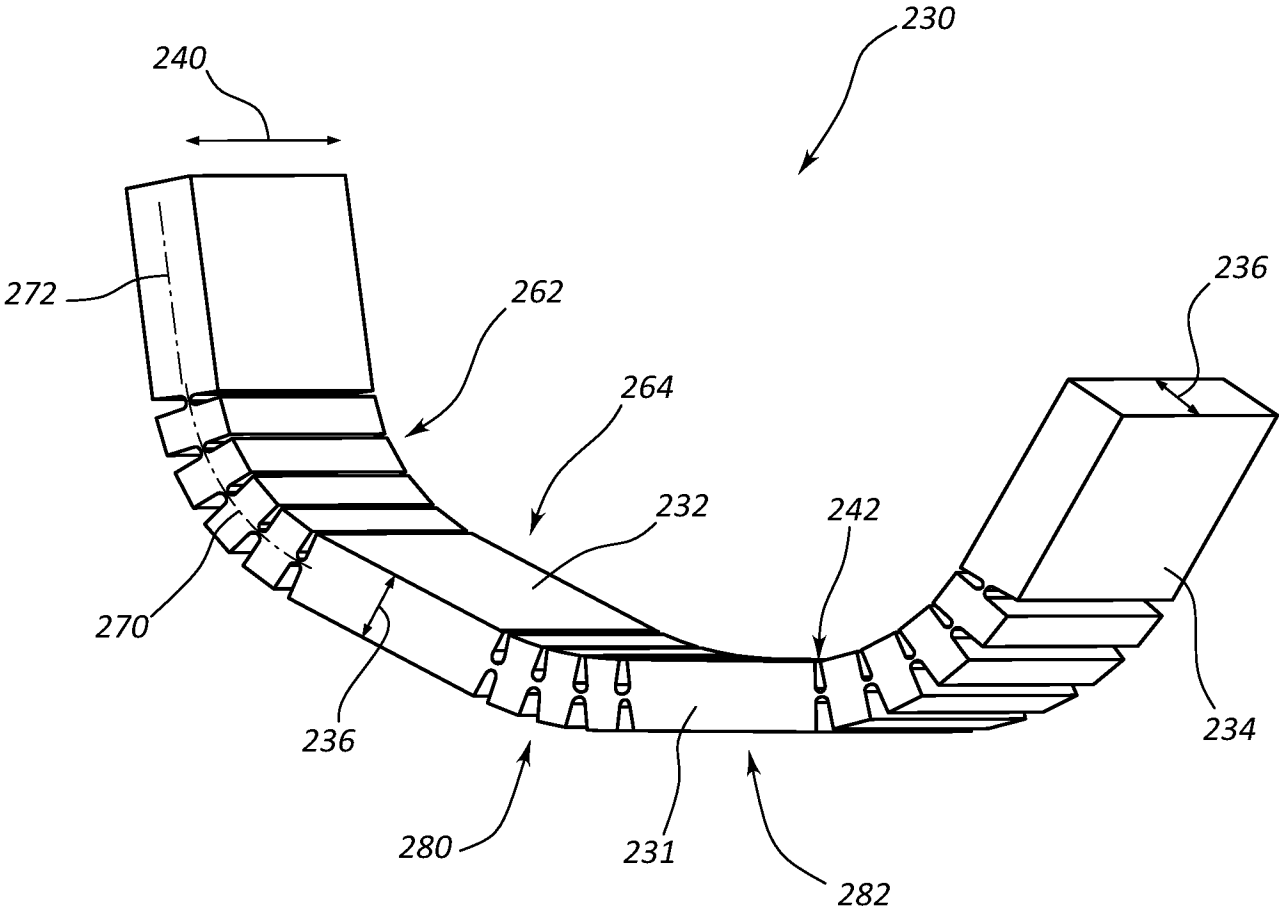
FIG. 6 is a perspective view of the wear pad in FIG. 4 in its installed position.
Figure 7:
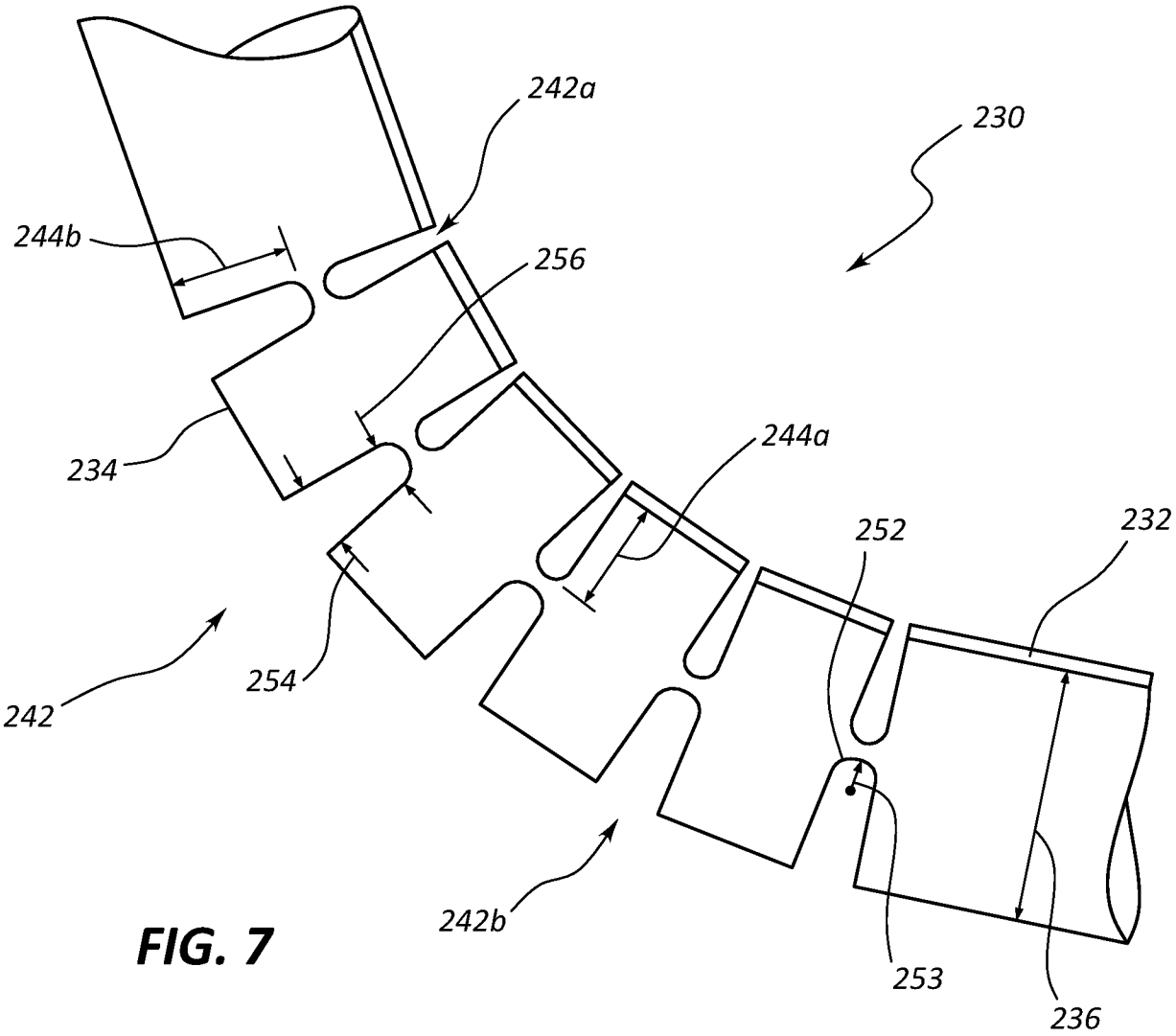
FIG. 7 is a close-up perspective view of the wear pad in FIG. 6.

Turning to FIGS. 4-7, an embodiment of a wear pad 230 includes a first surface 232 and a second surface 234 spaced apart a height 236 from the first surface 232. The wear pad 230 also includes a length 238 and a depth of 240. FIGS. 4 and 5 illustrate the wear pad 230 in the uninstalled position, while FIGS. 6 and 7 illustrate the wear pad 230 in an installed shape and orientation. As illustrated in FIGS. 4 and 5, the height 236 and depth 240 are significantly less than the length 238, which results in a wear pad 230 that is rectangular in shape. Optionally, the height 236 between the first surface 232 and the second surface 234 is substantially the same across at least one of the length 238 and a width 240 of the wear pad 230. In yet other embodiments, the height 236 between the first surface 232 and the second surface 234 is configured to vary less than 10 percent of an average height across at least one of the length 238 and the width 240 of the wear pad 230.

Various heights, lengths, and depths of the dimensions/measurements of the wear pad, however, can be used in various embodiments of the wear pad. Further, the terms height, depth, and length as used herein merely distinguish the various dimensions and do not connote the magnitude of a given dimension relative to the other dimensions. Consequently, wear pads of other shapes, including square, oval, round, and other geometric shapes are contemplated. In other shapes, such as ovals and circles, the major and minor axes correspond to the terms length and depth as appropriate.

The wear pad 230 can be made of any material 231 (FIG. 4), although typically it is made of a wear-resistant material that has a relatively low coefficient of friction relative to other materials. In some embodiments, the material of the wear pad is a metal. In yet other embodiments, the material of the wear pad is a plastic, thermoplastic, thermoset, or other similar materials. For example, the material 231 may be nylon or nylon-based materials. Optionally, the material 231 includes a friction modifier (not illustrated) that reduces the coefficient of friction of the base material 231 further. The friction modifier optionally includes at least one of a lubricant applied to at least one of the first surface 232 and the second surface 234 of the wear pad 230 and a lubricant integral to the material 231 of the wear pad 230. For example, the material 231 may be impregnated with molybdenum, and/or oils, and/or other wet and/or dry lubricants.

The wear pad 230 includes at least one groove or recess 242 in at least one of the first surface 232 and the second surface 234. In some embodiments, the wear pad 230 includes a plurality of grooves 242. The first surface 232 and the second surface 234 could be a top surface and bottom surface in some embodiments, while in alternative embodiments the first surface and the second surface could be a front and rear of the wear pad or a left side and a right side, for example. As illustrated in FIG. 4, the wear pad 230 optionally includes at least one groove 242*a* in the first surface 232 and at least another groove 242*b* in the second surface 234.

The groove 242 extends at least partly across a dimension of the wear pad 230. For example, the grooves 242*a* and 242*b* extend fully across the depth 240 of the wear pad 230. In other embodiments, the grooves 240 extend only partly across the depth 240 and/or the length 238 of the wear pad 230. As illustrated in FIG. 4, at least one groove 242 is oriented parallel to the depth 240 of the wear pad 230, although the groove 242 or other grooves in the plurality of grooves may be parallel to another dimension, such as the height 236 or the length 238, or not parallel to any of the dimensions.

The groove 242 extends a depth 244 into at least one of the first surface 232 and the second surface 234, wherein the depth 244 is less than the height 236 between the first surface 232 and the second surface 234. As illustrated in FIG. 4, the groove 242*a* in the first surface 232 extends a depth 244*a* into the first surface 232, and the groove 242*b* extends a depth 244*b* into the second surface 234, each depth 244*a* and 244*b* being less than the height 236. Optionally, and as illustrated in FIG. 5, a sum of the depth 244*a* of the first groove 242*a* and the depth 244*b* of the second groove 242*b* is less than the height 236.

Optionally, the wear pad 230 includes at least a portion 241 of the plurality of grooves 242 that are parallel to at least another portion 243 of the plurality of grooves 242. Alternatively, the portion 241 of the plurality of grooves 242 may be only partially parallel, i.e., parallel over a segment or a length of the groove to another portion 243 of the plurality of grooves 242 (not illustrated), or in yet other embodiments a portion 241 of the plurality of grooves 242 may not parallel another portion 243 of the plurality of grooves 242 (not illustrated).

Referring to FIG. 5, at least one groove 242*a* optionally includes a first axis 248. At least another groove 242*b* optionally includes a second axis 250. In some embodiments, the first axis 248 and the second axis 250 are parallel. Optionally, the first axis 248 and the second axis 250 are in a plane parallel to at least one of the height 236, the length 238, or the depth 240. Of course, the first axis 248 and the second axis 250 may not be parallel in other embodiments.

The groove 242 optionally includes a root 252 with a radius of curvature 253 in some embodiments. In other embodiments, the root 252 is the intersection of two planes. As illustrated by comparing FIGS. 5 and 7, the radius of curvature 253 of the root 252 may change between the uninstalled position of the wear pad (FIG. 5) and the installed position (FIG. 7).

FIG. 5 also illustrates an optional feature in which the at least one groove 242 includes a first width 254 proximate at least one of the first surface 232 and the second surface 234 and a second width 256 proximate the root 252 of the at least one groove 242. In the uninstalled position illustrated in FIG. 5, the first width 254 is approximately the same as the second width 256. In other embodiments, in the uninstalled position of the wear pad, the first width 254 is greater than the second width 256, and yet in other embodiments the first width 254 is less than the second width 256. The first width 254 and the second width 256 may change when the wear pad is positioned in the installed position, as illustrated in FIG. 7.

In those embodiments of a wear pad in which there exists a plurality of grooves 242, there exists a pitch 260 (FIG. 5) that defines the distance between the same structure or feature on adjacent grooves 242. Thus, in some embodiments, the wear pad 230 includes a first portion 262 with a given pitch 260 between adjacent grooves 242 and a second portion 264 with a different pitch 260, as illustrated in FIG. 4. FIG. 3 also illustrates the concept in which the pitch 160 of the grooves 142 differs between a first portion 162 and a second portion 164.

The wear pad 230 may include at least a first bending plane 270 positioned a first distance 271 between the first surface 232 and second surface 234, as illustrated in FIG. 4. In some embodiments there exists a second bending plane 272 positioned a second distance 273 between the first surface 232 and the second surface 234. A bending plane or neutral plane is the plane in which neither compressive forces nor tensile forces act. In FIGS. 4-7, the first bending plane 270 and the second bending plane 274 are equidistant between the first surface 232 and the second surface 234 so that the first distance 271 and second distance 273 are substantially the same (e.g., within 10% of the distance of the other). In other embodiments, however, and as will be discussed below, the first distance is different from the second distance.

The wear pad 230 also may include a first portion 280 that includes at least one groove 242 and has a first bending stiffness, as illustrated in FIG. 4. The wear pad 230 also may have a second portion 282 that has a second bending stiffness. The second portion may have none, one, or a plurality of grooves 242 within the second portion 282. Further, the bending stiffness of the second portion 282 may be different than the bending stiffness of the first portion 280, which is typically the case, although in other embodiments the bending stiffness in the first portion 280 and the second portion 282 are the same. As illustrated in FIG. 4, the bending stiffness of the second portion 282 is greater than the bending stiffness of the first portion 280.

The bending stiffness is the resistance of the wear pad against bending deformation, such as may occur when installing the wear pad 230 and once the wear pad 230 is installed between the first section 20 and the second section 25 of the telescoping boom assembly 15. The bending stiffness is a function of the elastic modulus of the wear pad 230 (i.e., a function of the material 231), the area moment of inertia of the cross-section of the wear pad 230 about the axis of interest, the length of the wear pad 230, and the boundary conditions (i.e., the forces applied at the ends and surfaces of the wear pad 230, amongst other locations).

The first portion 262 and/or the second portion 264 with the pitch of the grooves 242 of the wear pad 230 may be the same portion or a different portion from one or more of the first and second portions 270, 272 with the bending planes. Likewise, the first portion 262 and/or the second portion 264 may be the same portion or a different portion from one or more of the first and second portions 280, 282 of bending stiffness. Similarly, the first portion 270 and/or the second portion 272 of the bending plane may be the same portion or a different portion from one or more of the first and second portions 280, 282 of bending stiffness.

Figure 8:
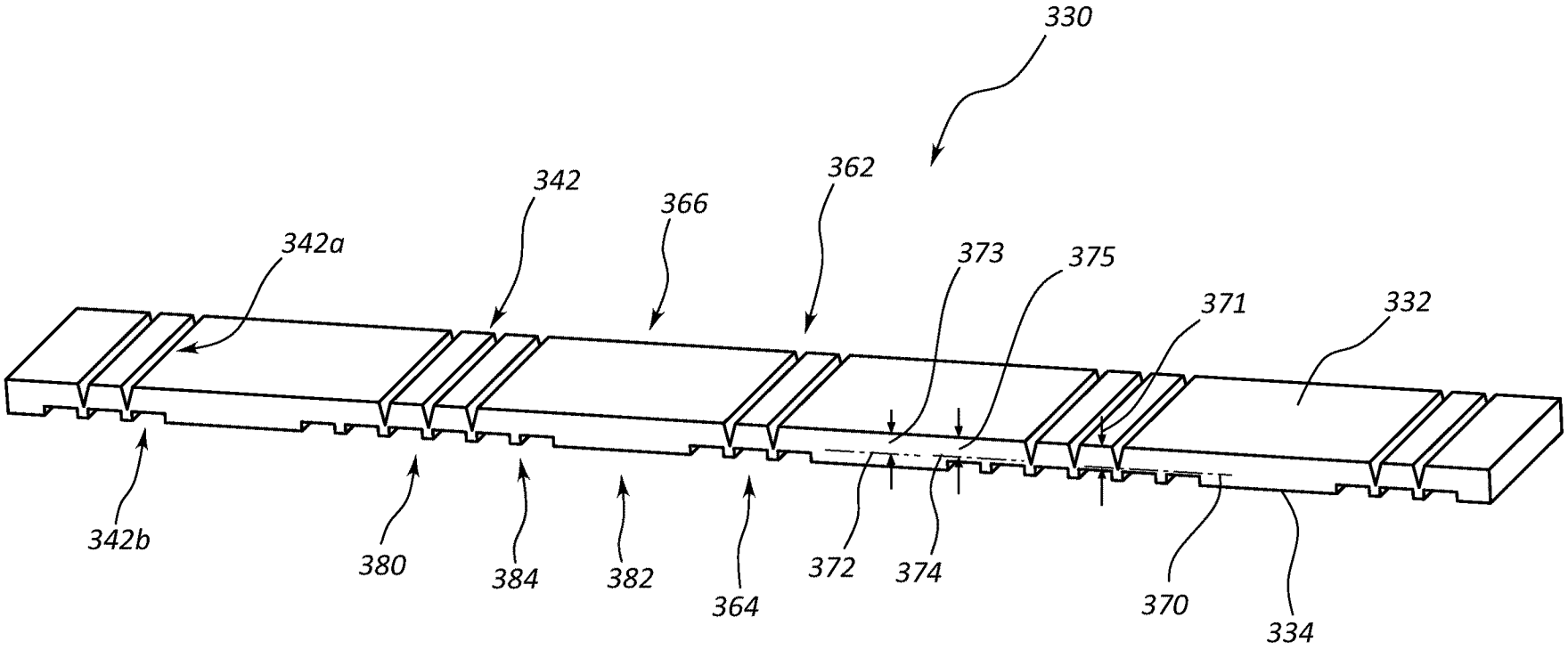
FIG. 8 is a perspective view of another embodiment of a wear pad in its uninstalled position.
Figure 9:
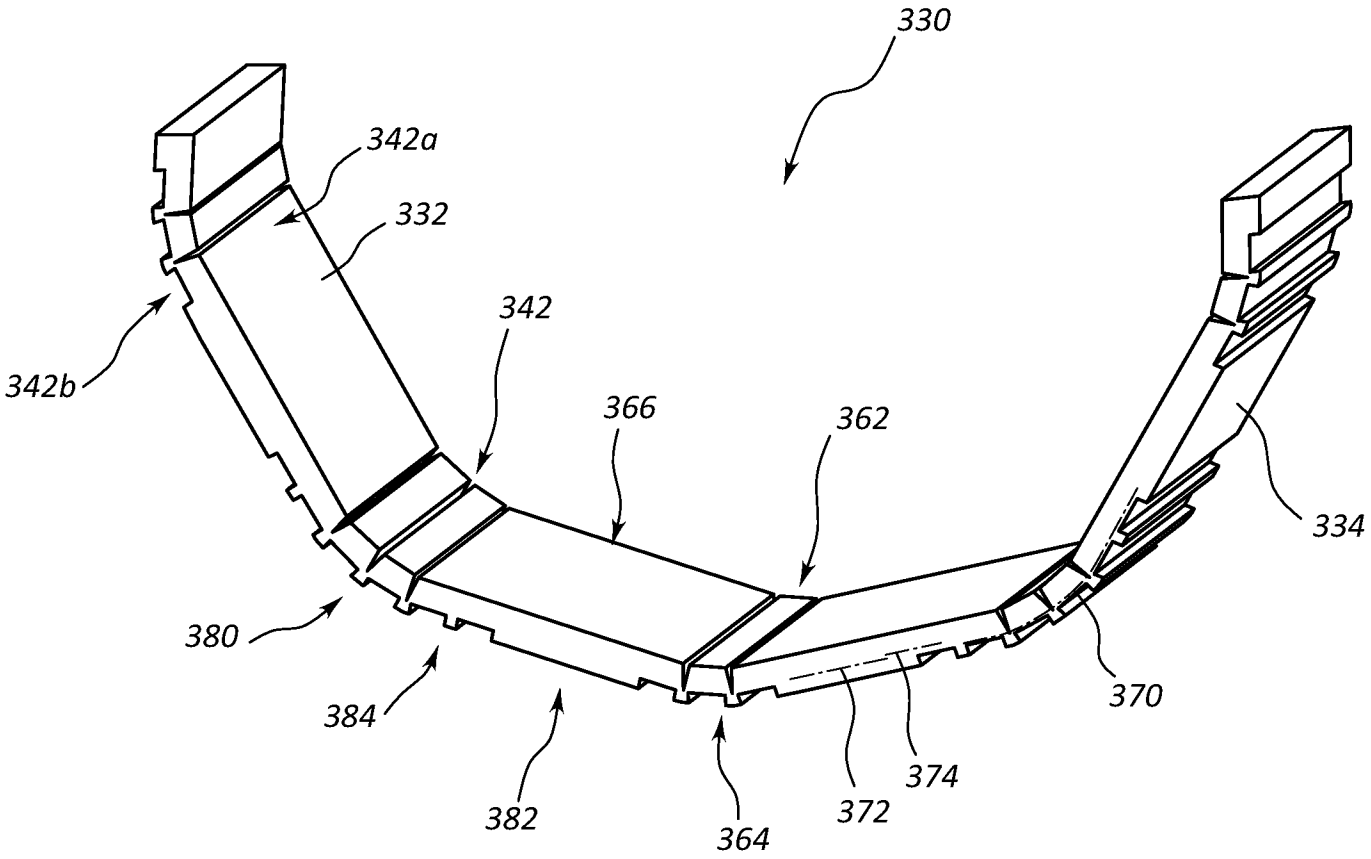
FIG. 9 is a perspective view of the wear pad in FIG. 8 in its installed position.
Figure 10:
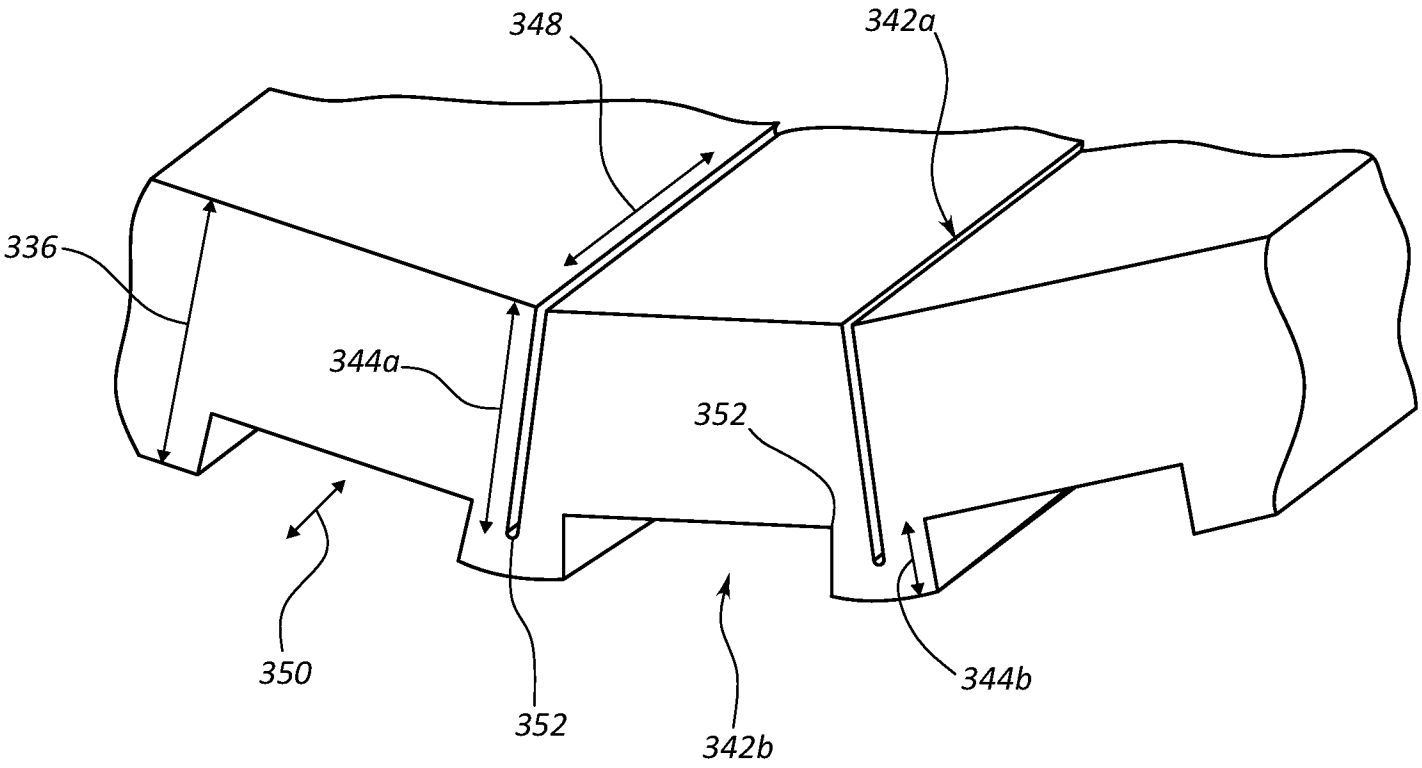
FIG. 10 is a close-up perspective view of the wear pad in FIG. 9.

Turning to FIGS. 8-10 is another embodiment of a wear pad 330. The wear pad 330 optionally incorporates any combination, including all, of the features recited above with respect to wear pad 230. Thus, the discussion of wear pad 330 focuses on the apparent differences.

The wear pad 330 includes a plurality of grooves 342 on both the first surface 332 and the second surface 334. The wear pad 330 includes a first portion 362 with a given pitch between adjacent grooves 342, a second portion 364 with another pitch between adjacent grooves 342, and a third portion 366 with yet another pitch between adjacent grooves 342. Thus, it can be seen that there may be any number of portions of a wear pad with given pitches between grooves, which may be different and/or the same (e.g., the pitch in the first portion 362 is the same as the pitch in the second portion 364, which are both different from the pitch in the third portion 366). In wear pad 330, each of the pitches in the first portion 362, second portion 364, and third portion 366 are different from the others.

The wear pad 330 may include at least a first bending plane 370 positioned a first distance 371 between the first surface 332 and second surface 334, as illustrated in FIG. 8. In some embodiments there optionally exist one or more additional bending planes. In the wear pad 330 there exists a second bending plane 372 positioned a second distance 373 between the first surface 332 and the second surface 334. There also exists a third bending plane 374 positioned a third distance 375 between the first surface 332 and the second surface 334. As illustrated in FIG. 8, the first distance 371, the second distance 373, and the third distance 375 are all different from each other.

Optionally, the wear pad 330 also may include a first portion 380 that includes at least one groove 342 and has a first bending stiffness, as illustrated in FIG. 8. The wear pad 330 also may have one or more additional portions. For example, the wear pad 330 includes a second portion 382 that has a second bending stiffness. The second portion may have none, one, or a plurality of grooves 342 within the second portion 382. The wear pad 330 includes, in this example, a third portion 384 that has a third bending stiffness. The bending stiffness of the second portion 382 and the third portion 384 may be different than the bending stiffness of the first portion 380, which is typically the case; although in other embodiments the bending stiffness in one or more of the portions may be the same. As illustrated in FIG. 8, the bending stiffness of the second portion 382 is greater than the bending stiffness of the first portion 380 and the third portion 384, and the bending stiffness of the third portion 384 is greater than the bending stiffness of the first portion 380.

Turning to FIG. 10, additional optional differences with the wear pad 330 are identified. At least one groove 342*a* optionally includes a first axis 348. At least another groove 342*b* optionally includes a second axis 350. In contrast to the wear pad 230, the first axis 348 and the second axis 350 may not be parallel and/or may not lie in a plane parallel to one of the height, length, or depth of the wear pad 330. Thus, in this configuration the sum of the depth 344*a* of the groove 342*a* and the depth 344*b* of the groove 344*b* is greater than the depth 336 of the wear pad 330 because the grooves 342*a* and 342*b* are offset from each another.

In addition, the groove 342*a* and 342*b* optionally include a root 352 that is an intersection of two planes, at least within manufacturing tolerances. Thus, any root 352 has a minimal radius of curvature in its uninstalled position illustrated in FIG. 8. As illustrated by comparing FIGS. 8 and 10, the radius of curvature of the root 352 may change between the uninstalled position of the wear pad 330 (FIG. 8) and the installed position (FIGS. 9 and 10).

Figure 11:
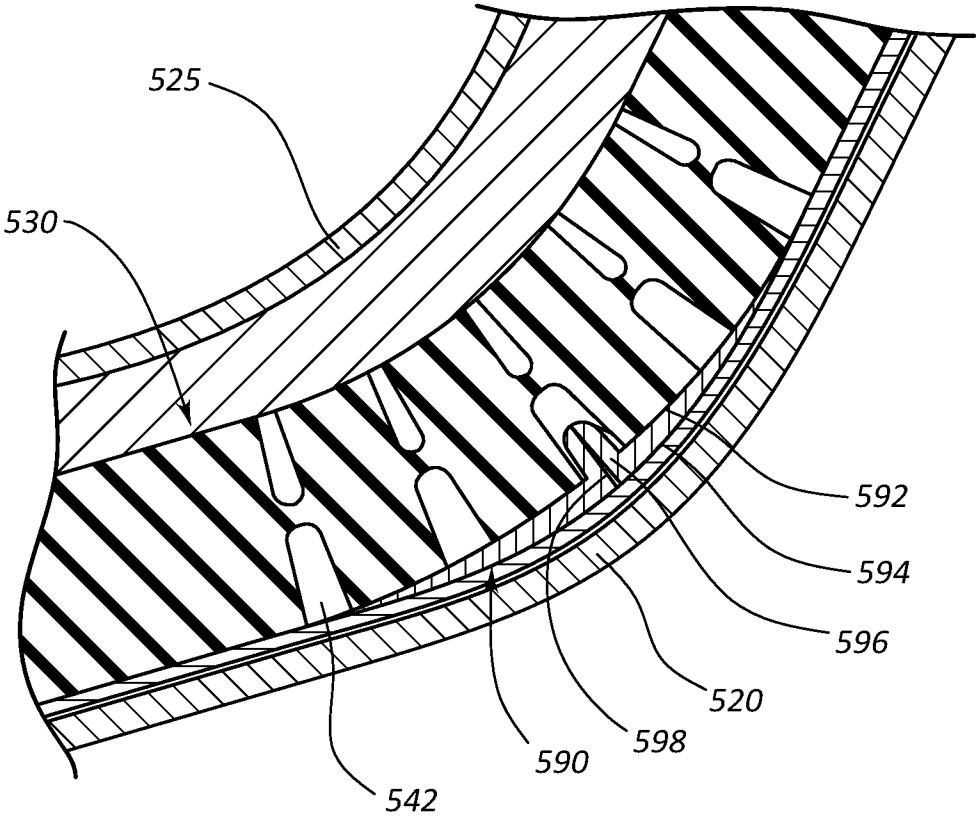
FIG. 11 is a close-up cross-section view of the wear pad in FIG. 6 installed in a telescoping boom assembly with associated shim.

Turning to FIG. 11, the construction vehicle 10 optionally includes at least one shim 590. Illustrated in FIG. 11 is a cross-section of a first section 520 and the second section 525 of a telescoping boom assembly similar to the telescoping boom assembly 15 in FIG. 1. A wear pad 530 with at least one groove 542 is positioned between the first section 520 and the second section 525. A shim 590, which may be manufactured from any material, but typically is formed of a thermoset, thermoplastic, metal, or other material, such as Teflon, may be positioned between one of the wear pad 530 and the first section 520 (most typically) or the wear pad 530 and the second section 525. The shim 590 allows for a better fit and accounts for manufacturing tolerances when positioning the wear pad 530 between the first section 520 and the second section 530.

The shim 590 includes at least a first surface 592 and a second surface 594 spaced apart from the first surface 592. Optionally, the shim 590 includes one or more ridges or protrusions 596 extending away from at least one of the first surface 592 and the second surface 594. As illustrated, the ridge 596 extends from the first surface 592 and is configured to be received in or extend into at least one of the grooves 542. In other words, the ridge 596 is dimensionally shaped (height, width, radius of curvature at a tip of the ridge) so as to fit within—whether loosely or with an interference fit—at least one groove 542.

Methods of manufacturing a wear pad are also disclosed. The method includes obtaining a material having a length, a first surface, and a second surface spaced apart a height from the first surface. The method further includes forming at least one groove that extends a depth into at least one of the first surface and the second surface, wherein the depth is less than the height between the first surface and the second surface. The groove may be formed by at least one of milling, sawing, molding, and ablating the material.

Optionally, the method includes forming a plurality of grooves. In such methods, at least a portion of the plurality of grooves may be formed parallel to at least another portion of the plurality of grooves. Optionally, the pitch of the plurality of grooves in a first portion of the material may differ from the pitch of the plurality of grooves in a second portion of the material.

Further, the step of forming at least one groove may include forming at least one groove in the first surface and forming at least another groove in the second surface. In such embodiments, the at least another groove extends a depth into the second surface less than the height between the first surface and the second surface.

The step of forming the at least one groove may include forming the at least one groove to include a first axis and forming the at least another groove to include a second axis, wherein the first axis and the second axis are parallel, and wherein a sum of the depth of the first groove and the depth of the second groove is less than the height between the first surface and the second surface.

The step of forming the at least one groove may include forming a root that includes a radius of curvature in the at least one groove.

The step of forming the at least one groove may include forming the at least one groove to include a first width proximate at least one of the first surface and the second surface and a second width proximate a root of the at least one groove, and wherein the first width is greater than the second width.

The step of forming the at least one groove may include orienting the at least one groove to be parallel to the length of the material.

The method may further include obtaining a material that includes a friction modifier integral to the material. Likewise, the method optionally includes applying a lubricant to at least one of the first surface and the second surface.

The method optionally includes obtaining or forming a material such that the height between the first surface and the second surface is substantially the same across at least one of the length and the width of the material. Optionally, the height between the first surface and the second surface is configured to vary less than 10 percent of an average height across at least one of the length and the width of the material.

The method optionally includes modifying a position of a first bending plane of a first portion of the material such that the first bending plane differs from a second bending plane of a second portion of the material.

The method also optionally includes modifying a first bending stiffness of a first portion of the material such that the first bending stiffness differs from a second bending stiffness of a second portion of the material.

Methods of installing a wear pad in position between a first section and a second section of a telescoping boom assembly of a crane are also disclosed. The method includes providing a wear pad that includes a length, a first surface and a second surface spaced apart a height from the first surface, and at least one groove that extends a depth into at least one of the first surface and the second surface, wherein the depth is less than the height between the first surface and the second surface. The method also includes positioning the wear pad between the first section and the second section of a telescoping boom assembly.

Yet another method of installing a wear pad in position between a first section and a second section of a telescoping boom assembly of a crane includes providing a wear pad that includes a length, a first surface and a second surface spaced apart a height from the first surface, a first portion having a first bending stiffness, and a second portion having a second bending stiffness, wherein the second bending stiffness is different than the first bending stiffness. Optionally, the height between the first surface and the second surface is substantially the same in the first portion and the second portion. The method further includes positioning the wear pad between the first section and the second section of a telescoping boom assembly.

Yet another method of installing a wear pad in position between a first section and a second section of a telescoping boom assembly of a crane includes providing a wear pad that includes a length, a first surface and a second surface spaced apart a height from the first surface, a first portion having a first bending plane, and a second portion having a second bending plane, wherein the position (i.e., the distance between the first surface and the second surface) of the second bending plane is different than the first bending plane. Optionally, the height between the first surface and the second surface is substantially the same in the first portion and the second portion. The method further includes positioning the wear pad between the first section and the second section of a telescoping boom assembly.

Yet another method of installing a wear pad in position between a first section and a second section of a telescoping boom assembly of a crane includes providing a wear pad that includes a length, a first surface and a second surface spaced apart a height from the first surface, and at least a plurality of grooves that extends a depth into at least one of the first surface and the second surface, wherein the depth is less than the height between the first surface and the second surface. The plurality of grooves in a first portion has a first pitch and the plurality of grooves in a second portion has a second pitch. The method further includes positioning the wear pad between the first section and the second section of a telescoping boom assembly.

The methods of installing the wear pad optionally include applying a lubricant to at least one of the first surface and the second surface of the wear pad.

The methods of installing the wear pad optionally include positioning at least one shim, the at least one shim including at least one ridge, such that the ridge extends at least partially into the at least one groove of the wear pad.

Optionally, the positioning of the wear pad in the various methods further includes one of (a) positioning the wear pad within an interior of the first section of the telescoping assembly and positioning the wear pad onto an exterior of the second section of the telescoping assembly and (b) positioning the second section of the telescoping assembly within the first section of the telescoping assembly.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

What is claimed is:

1. A wear pad for positioning between a first section and a second section of a telescoping boom assembly, the wear pad comprising:

a material that includes:

a first surface and a second surface spaced apart a height from the first surface;

a length;

a plurality of grooves that extend a depth into at least one of the first surface and the second surface, wherein the depth is less than the height between the first surface and the second surface; and a first end and a second end spaced apart from the first end by a length, wherein the height is substantially the same along the length from the first end to the second end.

2. The wear pad of claim 1, wherein at least a portion of the plurality of grooves is parallel to at least another portion of the plurality of grooves.

3. The wear pad of claim 1, wherein the plurality of grooves further comprises a first plurality of grooves in the first surface and a second plurality of grooves in the second surface, the second plurality of grooves extending a depth into the second surface less than the height between the first surface and the second surface.

4. The wear pad of claim 3, wherein the first plurality of grooves includes a first axis and wherein the second plurality of grooves includes a second axis, wherein the first axis and the second axis are parallel, and wherein a sum of the depth of the first plurality of grooves and the depth of the second plurality of grooves is less than the height between the first surface and the second surface.

5. The wear pad of claim 1, wherein the plurality of grooves are oriented parallel to the width of the material.

6. The wear pad of claim 1, wherein the wear pad further comprises:

a first portion that includes:

the plurality of grooves; and, a first bending plane positioned at a first distance between the first surface and the second surface; and, a second portion that includes a second bending plane positioned at a second distance between the first surface and the second surface, wherein the second distance is different than the first distance.

7. The wear pad of claim 1, wherein the wear pad further comprises:

a first portion that includes the plurality of grooves, the first portion having a first bending stiffness; and, a second portion having a second bending stiffness, wherein the second bending stiffness is different than the first bending stiffness.

8. The wear pad of claim 1, further comprising at least one of (a) a lubricant applied to at least one of the first surface and the second surface and (b) a lubricant integral to the wear pad.

9. The wear pad of claim 1, wherein the height between the first surface and the second surface is substantially the same across a width of the material.

10. The wear pad of claim 9, wherein the height between the first surface and the second surface is configured to vary less than 10 percent of an average height across the width of the material.

11. A construction vehicle comprising:

a telescoping boom assembly that includes a first section and at least a second section configured to nest within and to extend from the first section;

at least one shape-compliant wear pad positioned between the first section and the second section, the wear pad comprising a material that includes:

a first surface and a second surface spaced apart a height from the first surface;

a length;

at least one groove that extends a depth into the at least one of the first surface and the second surface, wherein the depth is less than the height between the first surface and the second surface;

a first portion that includes a first bending plane positioned at a first distance between the first surface and the second surface; and a second portion that includes a second bending plane positioned at a second distance between the first surface and the second surface, wherein the second distance is different than the first distance, wherein the height between the first surface and the second surface is substantially the same in the first portion and the second portion, wherein the material is configured to bend from an uninstalled position to an installed position, and wherein the first portion has a first bending stiffness and the second portion has a second bending stiffness, wherein the second bending stiffness is different than the first bending stiffness.

12. The construction vehicle of claim 11, wherein the construction vehicle comprises a crane.

13. The construction vehicle of claim 11, further comprising at least one shim, the at least one shim including at least one ridge configured to extend at least partially into the at least one groove.

14. A method of installing a shape-compliant wear pad in position between a first section and a second section of a telescoping boom assembly of a crane, the method comprising:

providing a wear pad that includes:

a length;

a first surface and a second surface spaced apart a height from the first surface;

a first portion having a first bending stiffness;

a second portion having a second bending stiffness, wherein the second bending stiffness is different than the first bending stiffness; and, wherein the height between the first surface and the second surface is substantially the same in the first portion and the second portion and, positioning the wear pad between the first section and the second section of a telescoping boom assembly, wherein positioning the wear pad comprises bending the wear pad from an uninstalled position to an installed position.

15. The method of claim 14, further comprising applying a lubricant to at least one of the first surface and the second surface.

16. The method of claim 14, further comprising positioning at least one shim, the at least one shim including at least one ridge, such that the ridge extends at least partially into the at least one groove.

17. The method of claim 14, wherein positioning the wear pad further comprises:

one of positioning the wear pad within an interior of the first section of the telescoping assembly and positioning the wear pad onto an exterior of the second section of the telescoping assembly;

positioning the second section of the telescoping assembly within the first section of the telescoping assembly.

* * * * *